US008647175B2

(12) United States Patent
Schmitz et al.

(10) Patent No.: US 8,647,175 B2
(45) Date of Patent: Feb. 11, 2014

(54) METHOD AND APPARATUS FOR FINISH MACHINING BALL TRACKS IN A NUT OF A BALL DRIVE

(75) Inventors: Thomas Schmitz, Wermelskirchen (DE); Siegfried Hesse, Wuppertal (DE); Hans-Joachim Koerner, Moenchengladbach (DE)

(73) Assignee: Thielenhaus Technologies GmbH, Wuppertal (DE)

( * ) Notice: Subject to any disclaimer, the term of this patent is extended or adjusted under 35 U.S.C. 154(b) by 354 days.

(21) Appl. No.: 13/109,117

(22) Filed: May 17, 2011

(65) Prior Publication Data

US 2011/0287695 A1 Nov. 24, 2011

(30) Foreign Application Priority Data

May 18, 2010 (DE) ..... 10 2010 020 814

(51) Int. Cl.
*B24B 35/00* (2006.01)
*B24B 19/06* (2006.01)

(52) U.S. Cl.
USPC ..... 451/51; 451/284; 451/482; 451/484

(58) Field of Classification Search
USPC ..... 451/186, 222, 284, 48, 484, 486, 51, 52
See application file for complete search history.

(56) References Cited

U.S. PATENT DOCUMENTS

| | | | | |
|---|---|---|---|---|
| 2,680,941 | A * | 6/1954 | Hahn | 451/27 |
| 3,030,739 | A * | 4/1962 | Folley | 451/52 |
| 3,031,808 | A * | 5/1962 | Spicacci et al. | 451/398 |
| 3,486,413 | A * | 12/1969 | Burgsmuller | 409/66 |
| 4,048,764 | A * | 9/1977 | Schmitz | 451/9 |
| 4,136,488 | A | 1/1979 | Wunder | |
| 4,860,501 | A * | 8/1989 | Belthle | 451/48 |
| 5,086,592 | A * | 2/1992 | Schreiber | 451/52 |
| 5,088,244 | A * | 2/1992 | Shirakura et al. | 451/48 |
| 5,170,590 | A * | 12/1992 | Sato et al. | 451/48 |
| 5,359,814 | A * | 11/1994 | Baltazar et al. | 451/5 |
| 5,586,469 | A * | 12/1996 | Mitani et al. | 74/424.86 |
| 5,681,209 | A * | 10/1997 | Naumann et al. | 451/51 |
| 5,702,294 | A * | 12/1997 | Baltazar et al. | 451/541 |
| 6,460,435 | B1 * | 10/2002 | Meyer et al. | 82/1.11 |
| 6,687,566 | B2 * | 2/2004 | Nishimoto et al. | 700/164 |
| 2004/0219866 | A1 * | 11/2004 | Sakai et al. | 451/21 |

FOREIGN PATENT DOCUMENTS

| | | | |
|---|---|---|---|
| DE | 10333909 | A | 3/2005 |
| DE | 102008000008 | A1 | 7/2009 |
| EP | 1884315 | B1 | 11/2010 |

* cited by examiner

*Primary Examiner* — Lee D Wilson
*Assistant Examiner* — Tyrone V Hall, Jr.
(74) *Attorney, Agent, or Firm* — Andrew Wilford

(57) ABSTRACT

A radially inwardly open raceway formed in a nut centered on a nut axis is machined by of oscillating the nut about the nut axis while pressing a tool secured in a holder radially outwardly into the raceway of the nut. The holder is moved parallel to the nut axis and oscillated about a tool axis perpendicular to the nut axis synchronously with the oscillation of the nut about the nut axis. Springs brace the tool against the holder parallel to the nut axis such that the tool can move limitedly in the holder against spring bias parallel to the tool axis.

4 Claims, 3 Drawing Sheets

METHOD AND APPARATUS FOR FINISH MACHINING BALL TRACKS IN A NUT OF A BALL DRIVE

FIELD OF THE INVENTION

The present invention relates to the manufacture of a ball-screw drive. More particularly this invention concerns the finish machining of the a ball raceway in a nut of a ball-screw drive.

BACKGROUND OF THE INVENTION

A ball-screw drive is composed of a spindle, a nut with a ball return, and balls as rolling elements. It is used to convert rotation into a linear motion, that is torque into thrust, or vice versa. For example, in a steering system the threaded spindle converts the rotation of an electric motor with high precision into a linear displacement of the threaded spindle, the smallest paths thus being easily and safely adjustable. The balls in a drive connect the spindle and the nut, rolling in raceways of the nut. The geometrical accuracy of the raceway and its surface quality have an effect on the smooth running and precision with which the adjusting movements can be carried out.

Different designs of nuts are known, differing primarily based on the type of ball return. The ball return can be a separate ball-circulation tube extending outside the nut. Nuts are also known with integrated ball return formed by passages or recesses on their inner surface forming a path for ball return.

From DE 103 33 909 a multipart nut is known having raceways and tracks for ball returns. The raceways formed by cold working are finished by grinding. The shape accuracy and the surface quality of the machined raceways have an effect on the service life of the ball-screw drive and the smooth running of the ball-screw drive. Waviness cannot be eliminated by grinding the raceway. In the case of very high requirement, for example in steering systems, ground raceways cannot yet fully meet requirements.

OBJECTS OF THE INVENTION

It is therefore an object of the present invention to provide an improved method of and apparatus for finish machining ball raceways in.

Another object is the provision of such an improved method of and apparatus for finish machining ball raceways in that overcomes the above-given disadvantages, in particular that produces a raceway of particularly high shape accuracy and surface quality in the section that is decisive for the power transmission of the ball-screw drive.

SUMMARY OF THE INVENTION

A radially inwardly open raceway formed in a nut centered on a nut axis is machined according to the invention by of oscillating the nut about the nut axis while pressing a tool secured in a holder radially outwardly into the raceway of the nut. The holder is moved parallel to the nut axis and oscillated about a tool axis perpendicular to the nut axis synchronously with the oscillation of the nut about the nut axis. Springs brace the tool against the holder parallel to the nut axis such that the tool can move limitedly in the holder against spring bias parallel to the tool axis.

Thus according to the invention, the ball raceway of a nut to be finished is machined by honing. Oscillations or reversing rotary motions of the workpiece to be machined around the workpiece longitudinal axis and oscillation movements of a finishing stone or a finishing tool engaging in the ball raceway to be machined are superimposed. According to the thread pitch of the ball raceway to be machined, the finishing tool has to be axially repositioned.

According to the method of the invention, during finish machining, depending on the angle of rotation, the tool holder thereby performs axial adjusting movements parallel to the longitudinal axis of the workpiece as well as oscillating rotary motions about an oscillation axis orthogonal thereto. With the movements to be coordinated with one another, namely the rotary motion of the workpiece and the straight-line motion of the workpiece, positioning inaccuracies must be avoided. In order to prevent positioning errors from having a disadvantageous effect on the finish result, the finishing tool is supported in the tool holder on springs in a floating manner in the direction of the axial adjusting movement of the tool holder. The springs are expediently designed such that they permit movement of the finishing tool inside the tool holder by up to 0.5 mm, preferably about 0.2 mm. Elastomeric disks are preferably used as springs.

The contact pressure of the finishing stone on the workpiece to be machined can be applied by compression springs. Preferably, the contact pressure of the finishing stone on the workpiece to be machined is however generated pneumatically.

The method according to the invention is used in order to machine the supporting part of a ball raceway. During machining, the workpiece performs reversing rotary motions or oscillation about an angle of rotation of preferably about 270°. The guide surfaces for ball return do not need any machining. Here larger tolerances as well as deviations in shape are harmless, since the ball return does not have an effect on the power transmission of a ball-screw drive.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
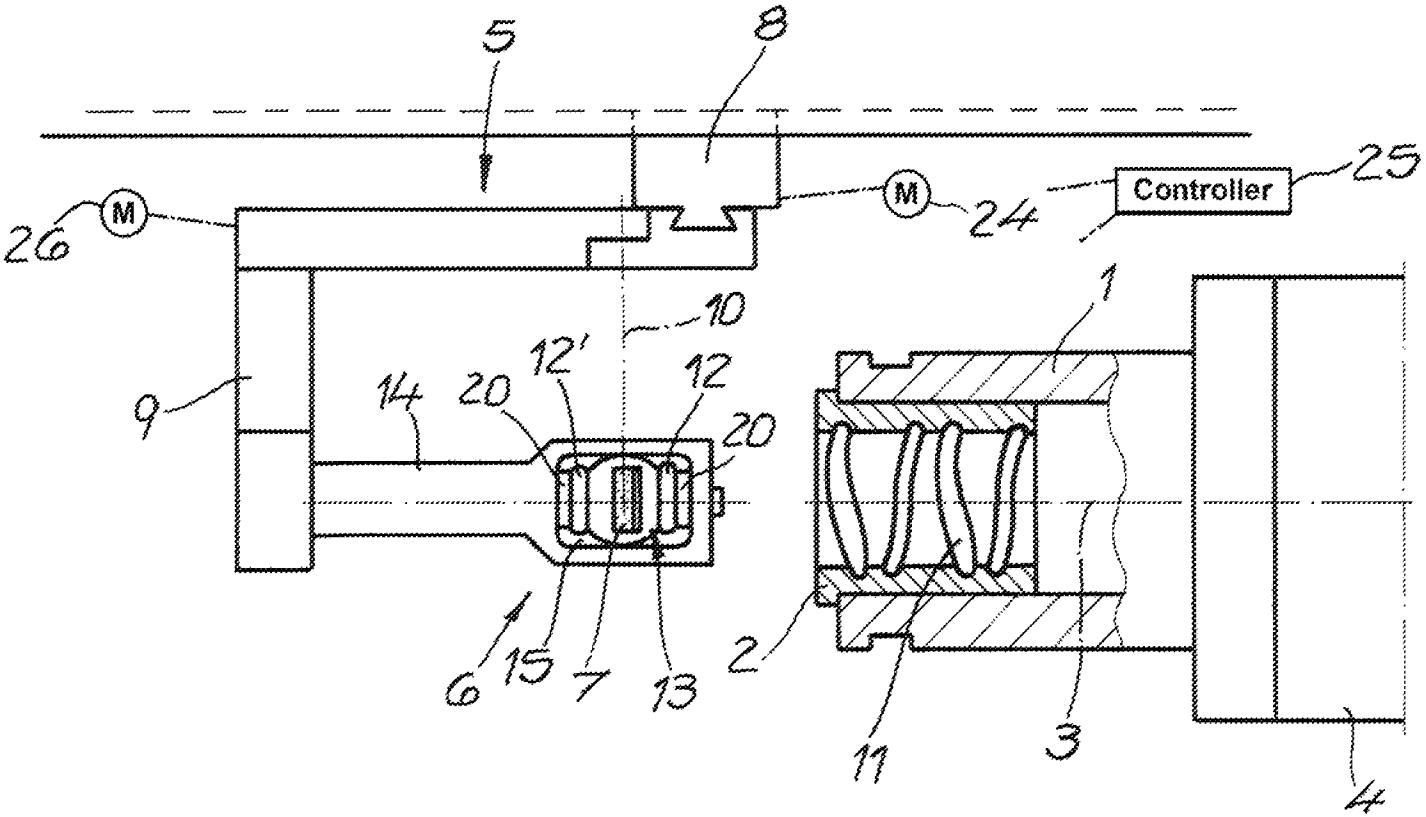
FIG. 1 is a schematic side view of an apparatus for finish machining raceways in a bal-drive nut for a ball-screw drive.

As seen in FIG. 1 an apparatus for finish machining raceways in a nut 2 which is intended for a ball-screw drive has a chuck 1 for the workpiece comprised by the nut 2 and operated by a drive 4 for oscillating the nut about its longitudinal axis 3. The apparatus further has a tool assembly 5 provided with a holder 6 for a finishing tool 7 and a two-axis positioner 8 for moving the tool holder 6 parallel to the axis 3 of the nut 3 as well as transversely thereto.

The positioner 8 is equipped with a drive 24 operated by a controller 25 for carrying out program-controlled adjusting movements. The tool holder 6 is mounted on a C-shaped support 9 that can pivot about an oscillation axis 10 on the positioner 8. This axis 10 is aligned orthogonally to the nut axis 3 and here is vertical, and it passes through the finishing tool 7. The oscillation axis 10 is equipped with another drive 26 also operated by the controller 25 ans serving to oscillate the support 9 and tool 7 about the axis 10.

The nut 2 has on its inner surface a ball raceway 11 that is finish machined by oscillating the nut 2 about its axis 3 while pressing the finishing tool 7 clamped in the holder 6 radially outwardly into engagement with the raceway 11. During finish machining, the tool holder 6, depending on the angle of rotation of the workpiece, performs in a program-controlled manner axial adjusting movements parallel to the nut axis 3 and oscillating rotary motions about the oscillation axis 10.

The finishing tool 7 is also supported in the tool holder 6 on springs 12 and 12' in a floating manner in the direction of the axial adjusting movement of the tool holder 6. The springs 12, which are preferably embodied as elastomeric washers or rings, permit a movement of the finishing tool 7 inside the tool holder 6 by up to 0.5 mm, preferably by about 0.2 mm. The contact pressure of the finishing tool 7 on the workpiece 2 to be machined is generated pneumatically.

Figure 2:
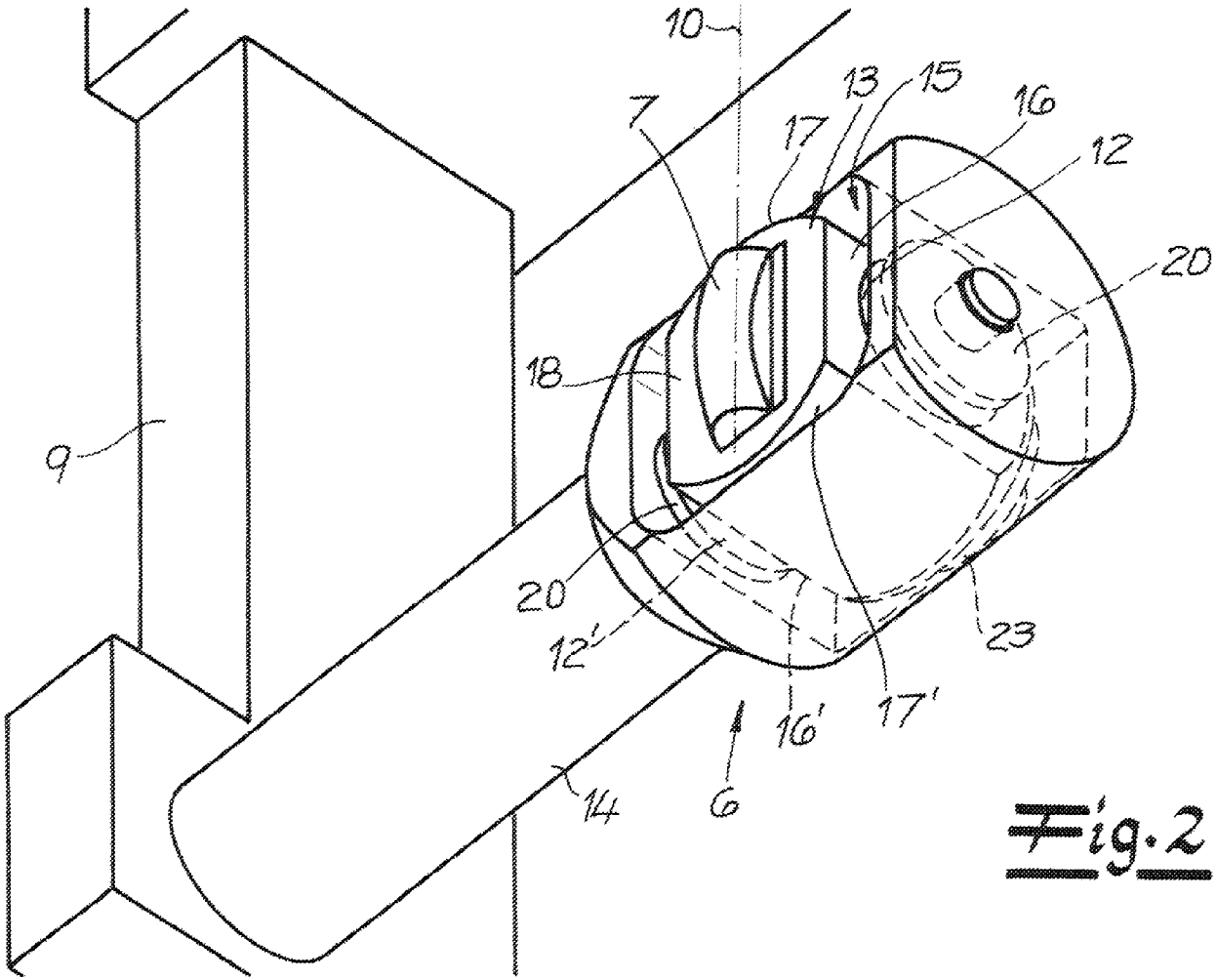
FIG. 2 is a perspective large-scale view from below of the tool holder of the apparatus.
Figure 3:
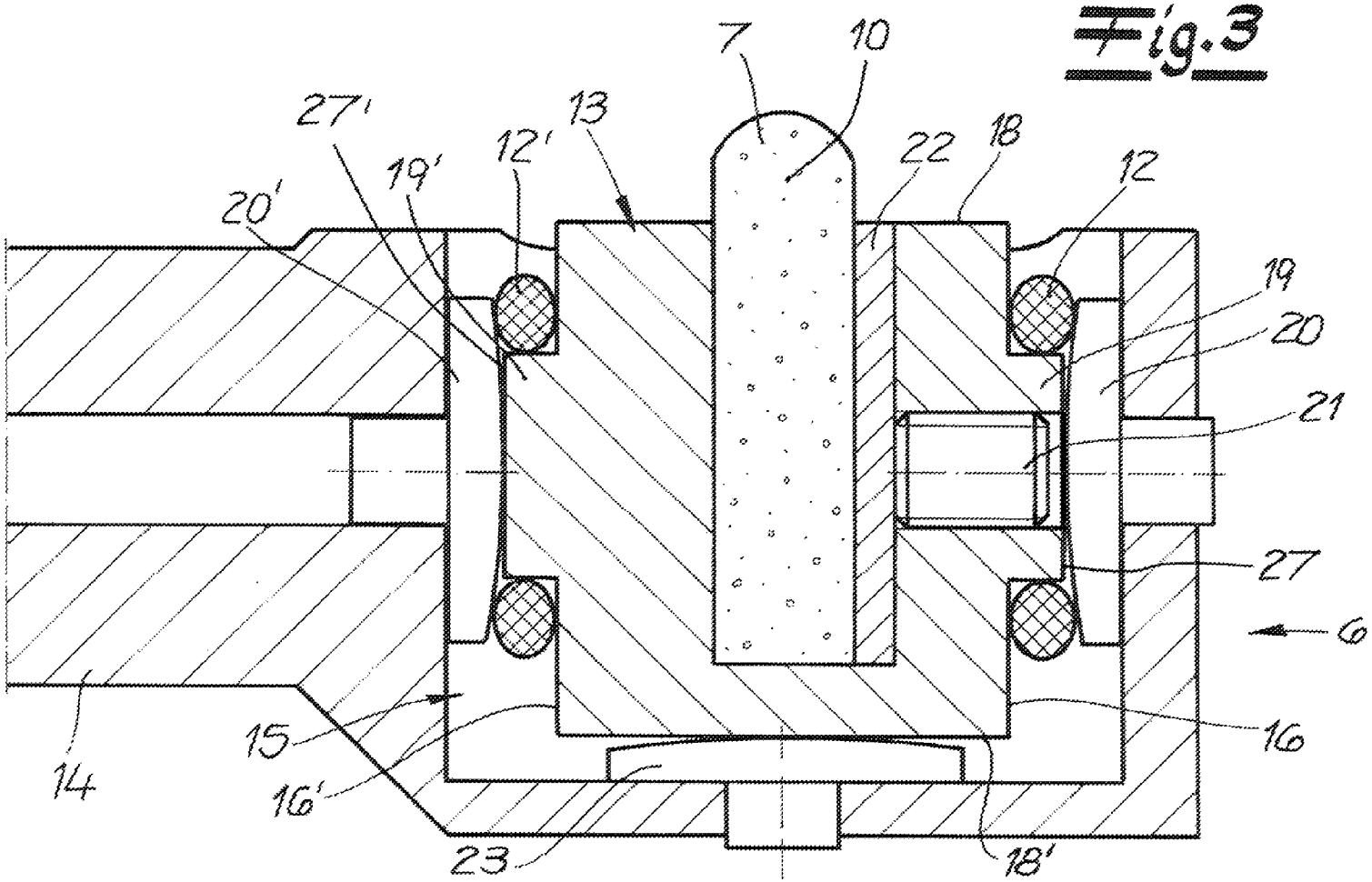
FIG. 3 is a longitudinal section through the outer end of the holder arm of the tool holder.

The tool holder 6 for carrying out the method described is shown in FIGS. 2 and 3. It has a body 13 in which the finishing tool 7 is mounted as well as a support arm 14 with an end cavity 15 for the body 13. The body 13 has planar axially oppositely directed left and right end faces 16 and 16' and part-cylindrical and outwardly convex upper and lower support faces 17 and 17' as well as a planar front face 18 formed with a recess for the finishing tool 7 and an opposite rounded rear end face 18'.

The body 13 is supported in a floating manner on the springs 12 and 12' that fit in the cavity 15 and bear against the respective end faces 16 and 16' of the body 13. The part-cylindrical upper and lower end faces 17 and 17', which are centered on axes perpendicular to a plane defined by the axes 10 and 3, permit pivoting or swiveling of the body 13 in the cavity 15 about an axis perpendicular to this plane. The springs 12 and 12' are elastomeric rings arranged on cylindrical projections 19 and 19' on the end faces 16 and 16' of the body 13. In the cavity 15 of the support arm 14 pressure plates 20 are arranged, which bear against the springs 12. As shown in FIG. 3, end faces the projections 20 and 20' are convexly shaped so as to meet planar end faces 27 and 27' of the projections 19 and 19' in point or line contact, or vice versa, so as to permit the body 13 to swivel in the recess. Similarly a pressure plate 23, which may be part of a pneumatic actuator, is convex toward a back face 18' of the body 13 to permit such swiveling.

The body 13 is formed with a slot that opens at the front face 18 and the tool is a flat grinding stone 7 with one edge that is rounded both about the axis 3 and perpendicular thereto and that projects from the front face 18. A plate 22 bears against one side of the flat stone 7 and is pressed by a big set screw 21 against the stone to lock it in place in the body 13.

We claim:

1. An apparatus for finish machining a radially inwardly open raceway formed in a nut centered on a nut axis, the apparatus comprising:

means for oscillating the nut about the nut axis;

a holder carrying a tool extending along a tool axis perpendicular to the nut axis;

springs bracing the tool against the holder parallel to the nut axis such that the tool can move limitedly in the holder against spring bias parallel to the tool axis; and drive means for pressing the tool in the holder radially outwardly into the raceway of the nut while same is oscillated about the nut axis and for moving the holder parallel to the nut axis and oscillating the tool about the tool axis synchronously with the oscillation of the nut about the nut axis.

2. The apparatus defined in claim 1, wherein the holder includes:

an arm pivotal about the tool axis, extending generally along the nut axis, and having an end formed with a recess open radially of the nut axis;

a holder body fittable in the recess and having a front face directed out of the recess radially of the tool axis, an opposite back face, a pair of axially oppositely directed side faces, and upper and lower faces bridging the side faces and engaging respective upper and lower flanks of the recess, the tool being fixed in the holder and projecting from the front face thereof, the springs being engaged between the side faces and respective flanks of the recess.

3. The apparatus defined in claim 2 wherein the tool axis extends through the tool where it projects from the front face.

4. The apparatus defined in claim 2 wherein the upper and lower faces are part-cylindrically curved and the respective flanks are substantially planar and parallel.

* * * * *